US009775428B2

(12) United States Patent
Johnson

(10) Patent No.: US 9,775,428 B2
(45) Date of Patent: Oct. 3, 2017

(54) PORTABLE CONTAINER HOLDER

(71) Applicant: HOLSTRIT, INC., Overland Park, KS (US)

(72) Inventor: Tamra L. Johnson, Overland Park, KS (US)

(73) Assignee: HOLSTRIT, INC., Overland Park, KS (US)

( * ) Notice: Subject to any disclaimer, the term of this patent is extended or adjusted under 35 U.S.C. 154(b) by 131 days.

(21) Appl. No.: 14/732,322

(22) Filed: Jun. 5, 2015

(65) Prior Publication Data

US 2015/0351571 A1 Dec. 10, 2015

Related U.S. Application Data

(60) Provisional application No. 62/008,929, filed on Jun. 6, 2014.

(51) Int. Cl.

| | |
|---|---|
| ***A45F 5/00*** | (2006.01) |
| *A45F 5/02* | (2006.01) |
| *A45C 13/00* | (2006.01) |

(52) U.S. Cl.

CPC ..... *A45F 5/00* (2013.01); *A45C 13/001* (2013.01); *A45C 2200/20* (2013.01); *A45F 5/021* (2013.01); *A45F 2005/006* (2013.01); *A45F 2200/0583* (2013.01)

(58) Field of Classification Search

CPC ..... A45F 5/00; A45F 2005/006; A45F 2200/0591

USPC ..... 224/148.1, 148.4–148.6; 2/247, 250, 252

See application file for complete search history.

(56) References Cited

U.S. PATENT DOCUMENTS

| | | | | |
|---|---|---|---|---|
| 6,328,146 | B1 * | 12/2001 | Siwak | A45C 3/00 150/106 |
| 6,742,636 | B2 * | 6/2004 | Godshaw | A45C 5/06 190/102 |
| 8,757,427 | B2 * | 6/2014 | Hiner | B65D 23/104 215/12.1 |
| 2007/0058887 | A1 * | 3/2007 | Godshaw | A45C 13/00 383/104 |
| 2008/0121673 | A1 * | 5/2008 | Timm | A45C 11/00 224/575 |
| 2012/0304357 | A1 * | 12/2012 | Highfield | A41D 1/002 2/69 |
| 2015/0108182 | A1 * | 4/2015 | Bruce | A45C 3/001 224/148.1 |
| 2015/0265478 | A1 * | 9/2015 | Seelinger | A61F 13/104 602/1 |

* cited by examiner

*Primary Examiner* — Justin Larson
*Assistant Examiner* — Phillip Schmidt
(74) *Attorney, Agent, or Firm* — Hovey Williams LLP

(57) ABSTRACT

A portable container holder is operable to receive a handheld container and broadly includes a support structure and a flexible sleeve. The support structure is operable to support the portable drink holder while being transported. The sleeve includes opposite side walls that present an elongated opening to slidably receive the drink container. The sleeve defines a sleeve axis along which the drink container slides into and out of the sleeve.

21 Claims, 15 Drawing Sheets

PORTABLE CONTAINER HOLDER

RELATED APPLICATION

This application claims the benefit of U.S. Provisional Application Ser. No. 62/008,929, filed Jun. 6, 2014, entitled BOTTLE HOLDER, which is hereby incorporated in its entirety by reference herein.

BACKGROUND

1. Field

The present invention relates generally to handheld containers and bags. More specifically, embodiments of the present invention concern a portable container holder operable to receive a handheld container.

2. Discussion of Prior Art

Various types of portable soft containers, such as bags, purses, and pouches, have long been used by consumers to carry personal items with them. Many of these soft containers are designed to be carried by hand or slung about a person's shoulder. Other known containers include a waist band to secure the container about a person's waist.

However, conventional soft containers have various deficiencies that make them unsuitable. For instance, conventional soft containers are bulky and uncomfortable to be carried by hand or worn by a person. Such soft containers are also unsuited for carrying personal drink containers, such as bottles, cans, cups, or glasses, that are filled with liquid. For instance, an open bottle of liquid carried in known soft containers is prone to be being spilled inside or outside the container.

SUMMARY

The following brief summary is provided to indicate the nature of the subject matter disclosed herein. While certain aspects of the present invention are described below, the summary is not intended to limit the scope of the present invention.

Embodiments of the present invention provide a portable container holder that does not suffer from the problems and limitations of the prior art engines set forth above.

A first aspect of the present invention concerns a portable container holder operable to receive a handheld container. The portable container holder broadly includes a support structure and a flexible sleeve. The support structure is operable to support the portable drink holder while being transported. The flexible sleeve includes opposite side walls and a flexible front wall that interconnects the side walls, with the walls cooperatively presenting an elongated opening to slidably receive the drink container. The sleeve defines a sleeve axis along which the drink container slides into and out of the sleeve. The sleeve defines a cross-sectional opening dimension transverse to the sleeve axis. The front wall is shiftable to permit the side walls to be moved toward and away from one another to adjust the size of the cross-sectional dimension.

A second aspect of the present invention concerns a portable container holder operable to receive a handheld container. The portable container holder broadly includes a support structure and a flexible sleeve. The support structure is operable to support the portable drink holder while being transported. The flexible sleeve includes opposite side walls that cooperatively present an elongated opening to slidably receive the drink container. The sleeve defines an opening length along which the drink container slides into and out of the sleeve. The sleeve is adjustably attached to the support structure, with at least part of the sleeve being collapsible along the sleeve axis to reduce the size of the opening length.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 14:
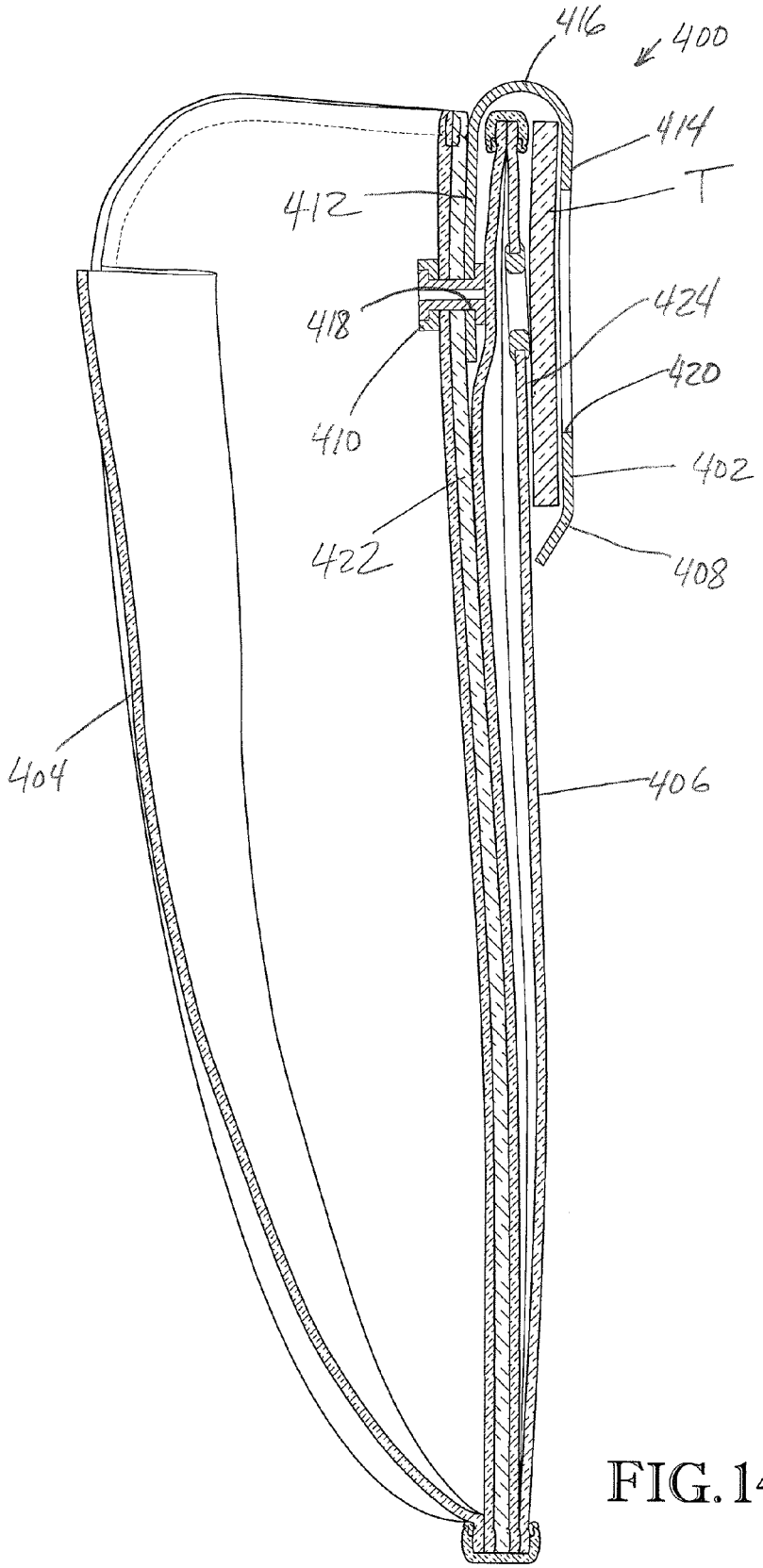
Figure 15:
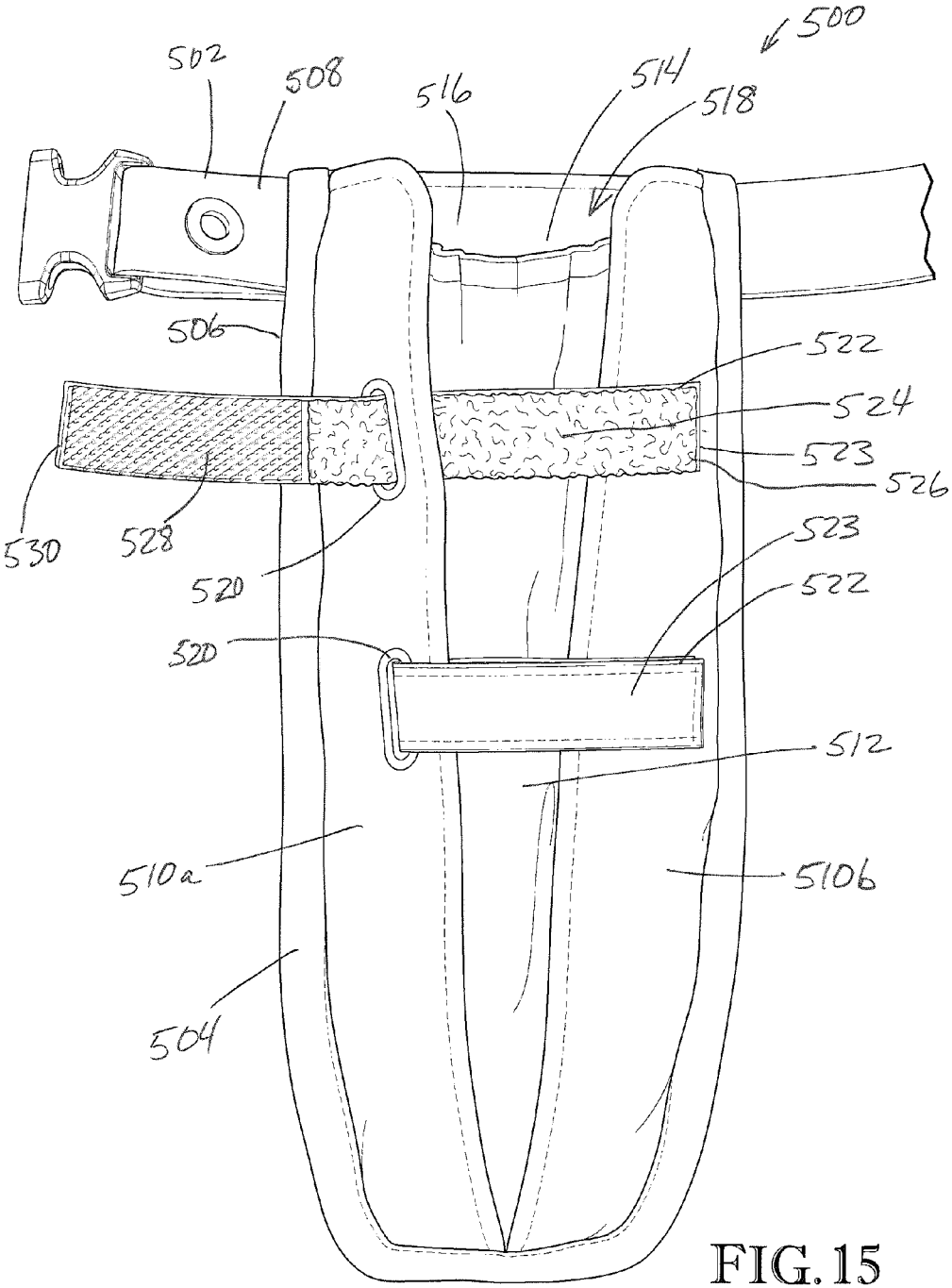

FIG. 14 is a fragmentary cross section of a portable container holder constructed in accordance with a fourth preferred embodiment of the present invention, with the holder including a base wall, a mounting clip, and a sleeve, and with the mounting clip being secured to the base wall and the sleeve with a fastener; and FIG. 15 is a perspective of a portable container holder constructed in accordance with a fifth preferred embodiment of the present invention, showing a mounting structure and a sleeve of the holder, with the sleeve including a pair of adjustment straps with hook-and-loop material to adjustably size the sleeve.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1-4, a portable drink container holder 20 is constructed in accordance with a preferred embodiment of the present invention. The holder 20 is preferably used by a wearer P to carry a handheld container with them. For instance, the holder 20 can be used to carry a drink container, such as a water bottle B. However, it is within the ambit of the present invention where the holder 20 is used to carry other types of containers. Furthermore, the holder 20 could be used to carry other handheld devices. The holder 20 preferably includes a support structure 22 and an expandable sleeve 24.

The support structure 22 is used to removably secure the holder 20 onto the wearer P. The illustrated support structure 22 preferably includes a base wall 26 and a waist strap 28 that are operable to cooperatively form an endless waist band 30 (see FIG. 1). However, as will be shown in subsequent embodiments, the support structure 22 could have an alternative construction.

The base wall 26 has a unitary construction and preferably includes an inner cloth layer (not shown) and an outer cloth layer 32 and an insulating layer (not shown) sewn between the inner cloth layer and the outer cloth layer 32. While the inner cloth layer and the outer cloth layer 32 preferably include a cloth material, the inner layer and/or outer layer 32 could include one or more alternative materials.

Figure 3:
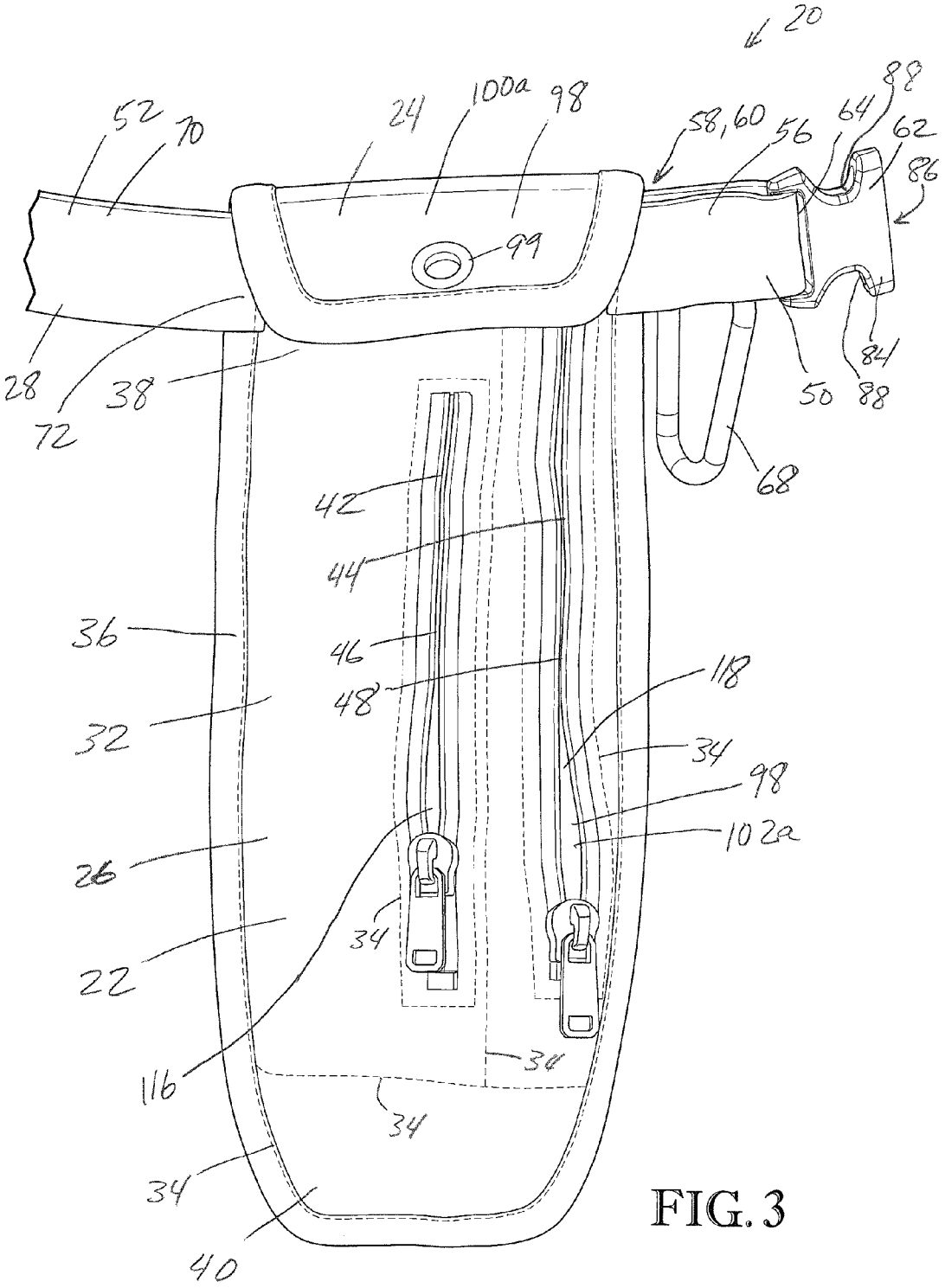
FIG. 3 is a fragmentary rear elevation of the portable container holder shown in FIGS. 1 and 2, showing zipper connectors mounted in the base wall to provide access to pockets in the holder.
Figure 4:
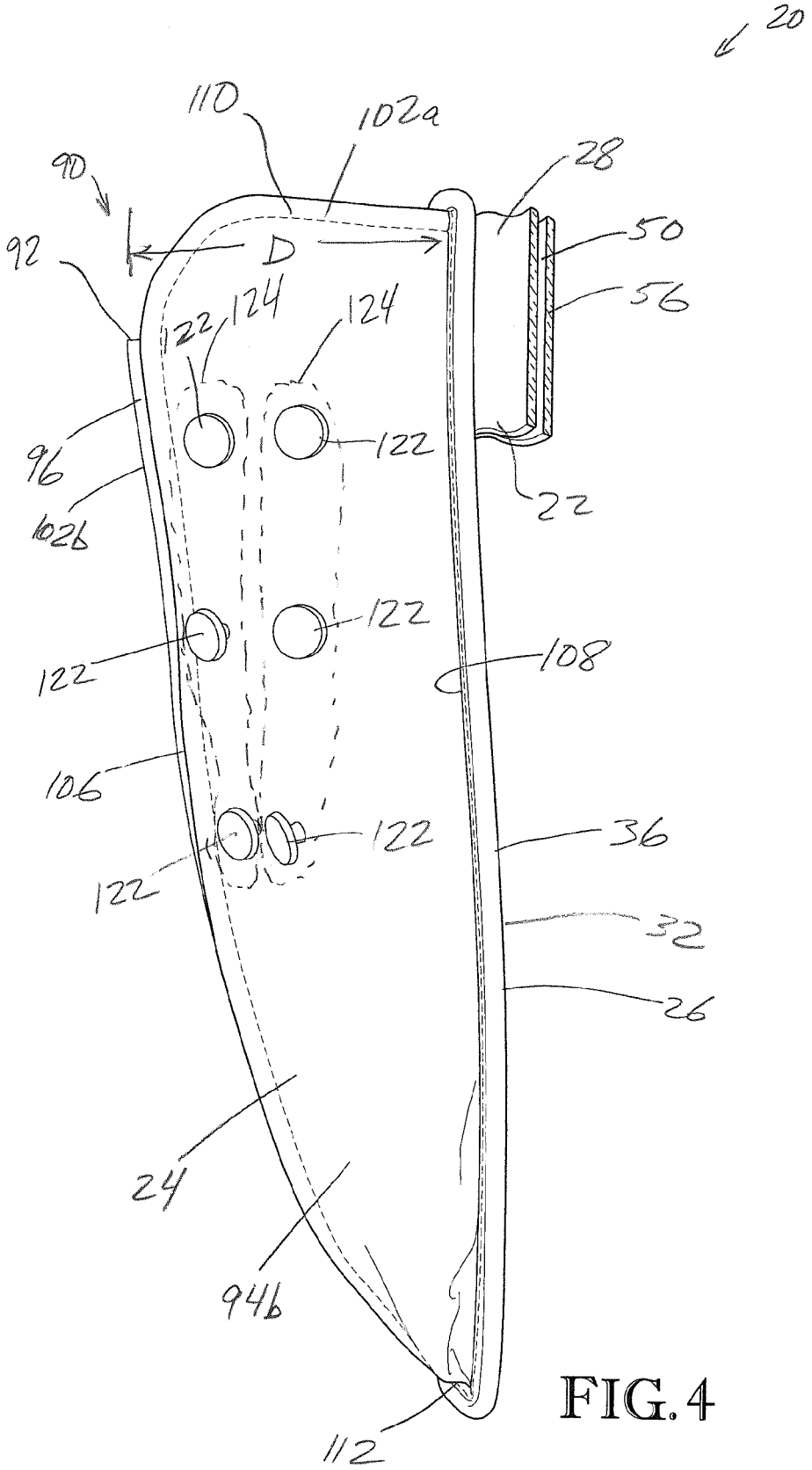
FIG. 4 is a fragmentary side elevation of the portable container holder shown in FIGS. 1-3, showing the sleeve in the expanded position.
Figure 5:
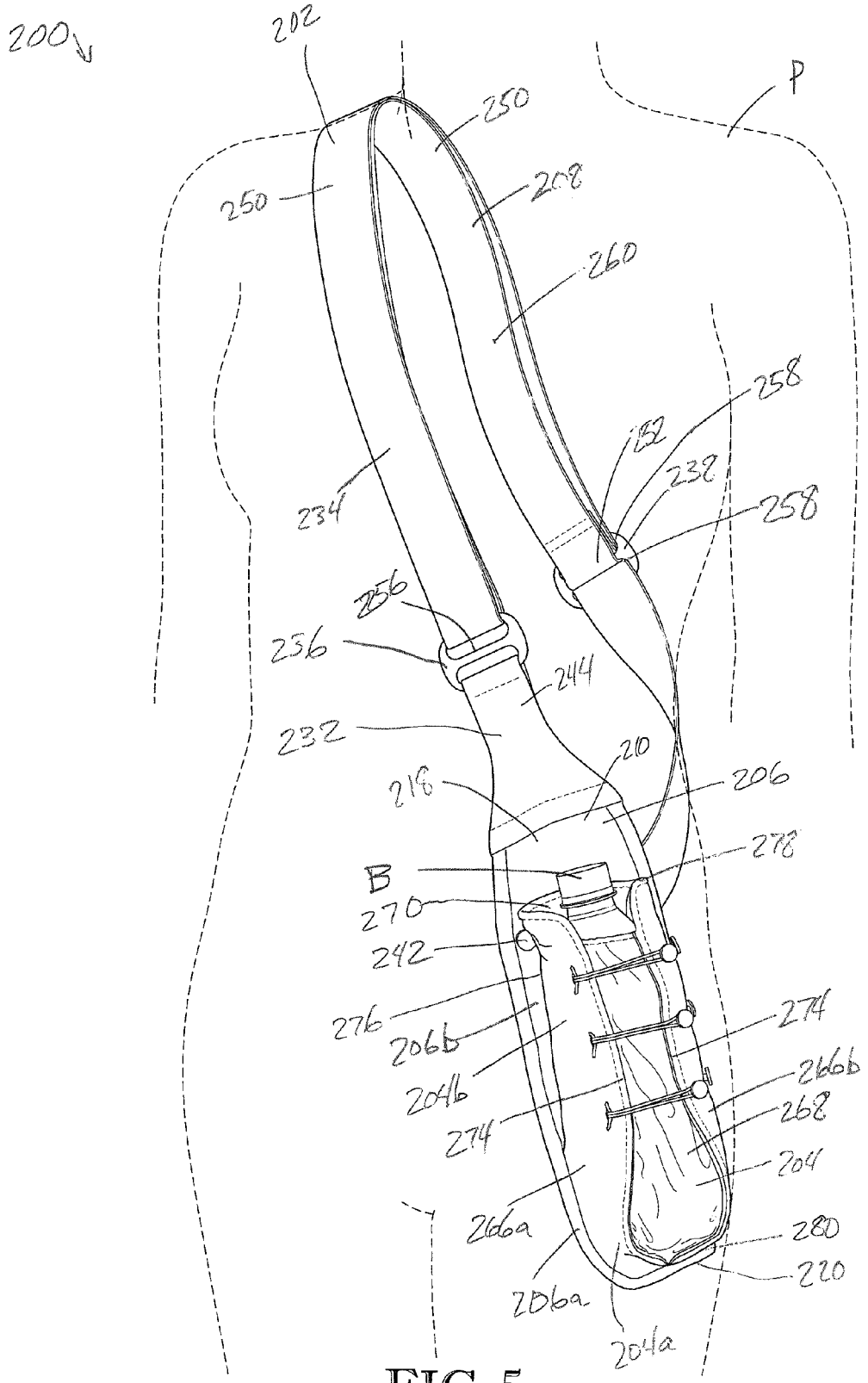
FIG. 5 is a perspective of a portable container holder constructed in accordance with a second preferred embodiment of the present invention, with the holder including a shoulder strap, a base wall, and an expandable sleeve, showing the holder slung onto the shoulder of the wearer, with connector loops of the sleeve attached to corresponding buttons to securely hold a bottle in the sleeve.
Figure 6:
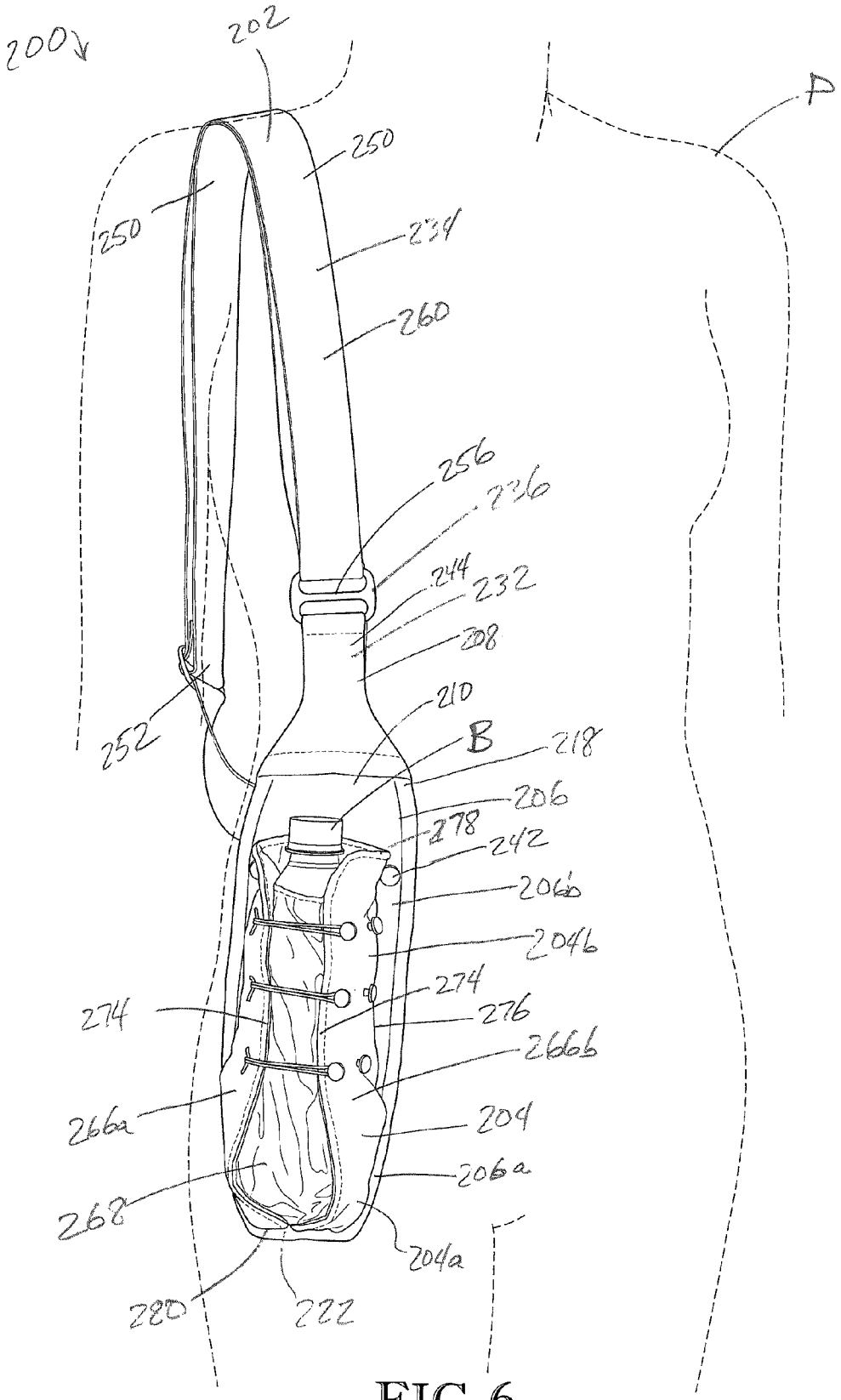
FIG. 6 is a perspective of a portable container holder similar to FIG. 5, but showing the holder slung onto the other shoulder of the wearer.

The inner cloth layer, outer cloth layer 32, and insulating layer are joined along outer sewing lines 34 to form an outer margin 36 of the base wall 26 (see FIG. 3). When sewn together, the inner cloth layer, outer cloth layer 32, and the insulating layer cooperate so that the base wall 26 is more rigid than each of the layers individually. As will be explained, the base wall 26 is sewn to the sleeve 24 and provides the sleeve 24 with additional insulation and rigidity.

The illustrated base wall 26 is elongated and presents upper and lower ends 38,40 (see FIG. 3). The base wall 26 preferably presents a maximum height dimension H and a maximum width dimension W (see FIG. 2). The height dimension H preferably ranges from about two inches (2") to about eighteen inches (18") and, more preferably, ranges from about six inches (6") to about twelve inches (12"). The width dimension W preferably ranges from about one inch (1") to about ten inches (10") and, more preferably, ranges from about two inches (2") to about six inches (6"). However, for some aspects of the present invention, the base wall could be alternatively sized.

The base wall 26 also preferably includes zipper connectors 42,44 that are generally aligned with the longitudinal axis of the base wall 26. The zipper connectors 42,44 define respective openings 46,48 that can be selectively opened and closed (see FIG. 3). As will be discussed, the openings 46,48 provide user access to pockets between the base wall 26 and the sleeve 24. While the zipper connectors 42,44 are preferred, the base wall 26 could include alternative closure devices (e.g., metal or plastic snaps, hook-and-loop material, elastic cord, metal or plastic buckles, or metal or plastic clasps) to selectively open and close the openings 46,48.

Preferably, the waist strap 28 cooperates with the base wall 26 to secure the holder 20 onto the wearer P. The waist strap 28 preferably includes two strap sections 50,52 and a buckle assembly 54 that removably attaches the strap sections 50,52 to one another.

The first strap section 50 includes a unitary cloth strip 56 that is elongated and presents opposite ends 58,60. Both ends 58,60 of the strip 56 are sewn to the base wall 26 adjacent the upper end 38. The strip 56 is attached to a buckle 62 of the buckle assembly 54 by passing the strip 56 through an opening 64 in the buckle 62. The strip 56 is doubled over and the ends 58,60 of the strip 56 are sewn to the base wall 26. The first strap section 50 also includes an eyelet 66 and a carabiner clip 68. The eyelet 66 is attached to and extends through the doubled-over portions of the strip 56.

Although the carabiner clip 68 is preferred, the holder 20 could include an alternative loop-type connecting structure, such as a D-ring, key ring, padlock, string, tie, ribbon, hook, and/or lanyard. Such structure can be used by the wearer to externally connect various handheld articles, such as keys, hand sanitizer, etc., to the holder 20. Furthermore, while the holder 20 preferably includes the eyelet 66 for attaching the clip 68, the clip 68 could be alternatively attached to the waist strap 28 (e.g., where the waist strap 28 does not include the eyelet 66).

The second strap section 52 includes a unitary cloth strip 70 that is elongated and presents opposite ends 72,74. The strip 70 is attached to a buckle 76 of the buckle assembly 54 by passing the strip 70 through a pair of openings 78 in the buckle 76. One end 72 of the strip 70 is sewn to the base wall 26 adjacent the upper end 38. The strip 70 is doubled over and fed through the buckle 76 so that the other end 74 of the strip 70 is loose.

The buckles 62,76 are removably attachable to one another to secure the waist strap 28 onto the wearer P. The buckle 76 includes a male buckle end 80 with a pair of flexible tabs 82 (see FIG. 2). The buckle 62 includes a female buckle end 84 that presents an open slot 86 to receive the male buckle end 80 (see FIG. 2). The female buckle end 84 also presents a pair of holes 88 that communicate with the open slot 86 and removably receive the tabs 82.

When the buckles 62,76 are connected to one another, the waist strap 28 and the base wall 26 cooperatively form an endless waist band 30 to be secured on the wearer P for supporting the holder 20. The buckles 62,76 can be selectively disconnected by the wearer P (e.g., to permit the wearer P to don the holder 20 or to permit the wearer P to remove the holder 20).

The support structure 22 is preferably constructed so that the base wall 26 is positioned substantially entirely below the waist strap 28. More specifically, the ends 58,60,72 of the strap sections 50,52 are attached adjacent to the upper end 38 of the base wall 26 so that substantially the entire base wall 26 hangs below the waist strap 28 when the holder 20 is donned. As will be discussed, this construction permits the holder 20 to support the bottle B in a secure and stable configuration.

While the illustrated band 30 is preferably secured snugly about the waist of the wearer P, it is within the ambit of the present invention for the band 30 to be used in various other carry arrangements. For instance, the illustrated strap 28 could be lengthened for use as a shoulder strap where the holder 20 is slung about the wearer's shoulder. It will also be appreciated that the strap 28 could be secured around the handle of a bag, briefcase, purse, tote, luggage, etc.

Although the illustrated waist strap 28 is integrally attached as part of the holder 20, it will be appreciated that the strap 28 could be removably attached to the sleeve 24 (e.g., to provide alternative carry options). For instance, the holder 20 could include multiple interchangeable support structures with different strap configurations (such as a shoulder strap or a luggage strap as shown in subsequent embodiments).

Referring again to FIGS. 1-4, the sleeve 24 is expandable to receive a container such as the bottle B. In particular, the sleeve 24 preferably presents an elongated adjustably-sized container opening 90 that extends continuously along an axis A of the sleeve 24 (see FIG. 2). The sleeve 24 also presents an open top 92 that communicates with the opening 90. The illustrated sleeve 24 preferably includes side walls 94*a,b*, front wall 96, and back wall 98.

The side walls 94 and the back wall 98 preferably include inner and outer layers 100*a*,102*a* and an insulating layer (not shown) sewn between the layers 100*a*,102*a*. The outer layers 102*a* preferably include a cloth material, although the outer layers 102*a* could include one or more alternative materials. The inner layers 100*a* preferably include a continuous sheet of synthetic resin material, although the inner layers 100*a* could include one or more alternative materials. The layers 100*a*,102*a* and the insulating layer are preferably sewn together to form each of the walls 94,98. Also, the back wall 98 preferably includes an eyelet 99 adjacent an upper end thereof (see FIG. 3).

While the side and back walls 94,98 include the insulating layer, these walls 94,98 preferably retain some flexibility to bend and conform to the bottle B or another container received by the holder 20. However, it is within the scope of the present invention where the walls 94,98 are substantially rigid. In such a configuration, the walls 94,98 could be pivotally connected to one another by a hinge structure, such as a living hinge provided by a flexible material.

Figure 1:
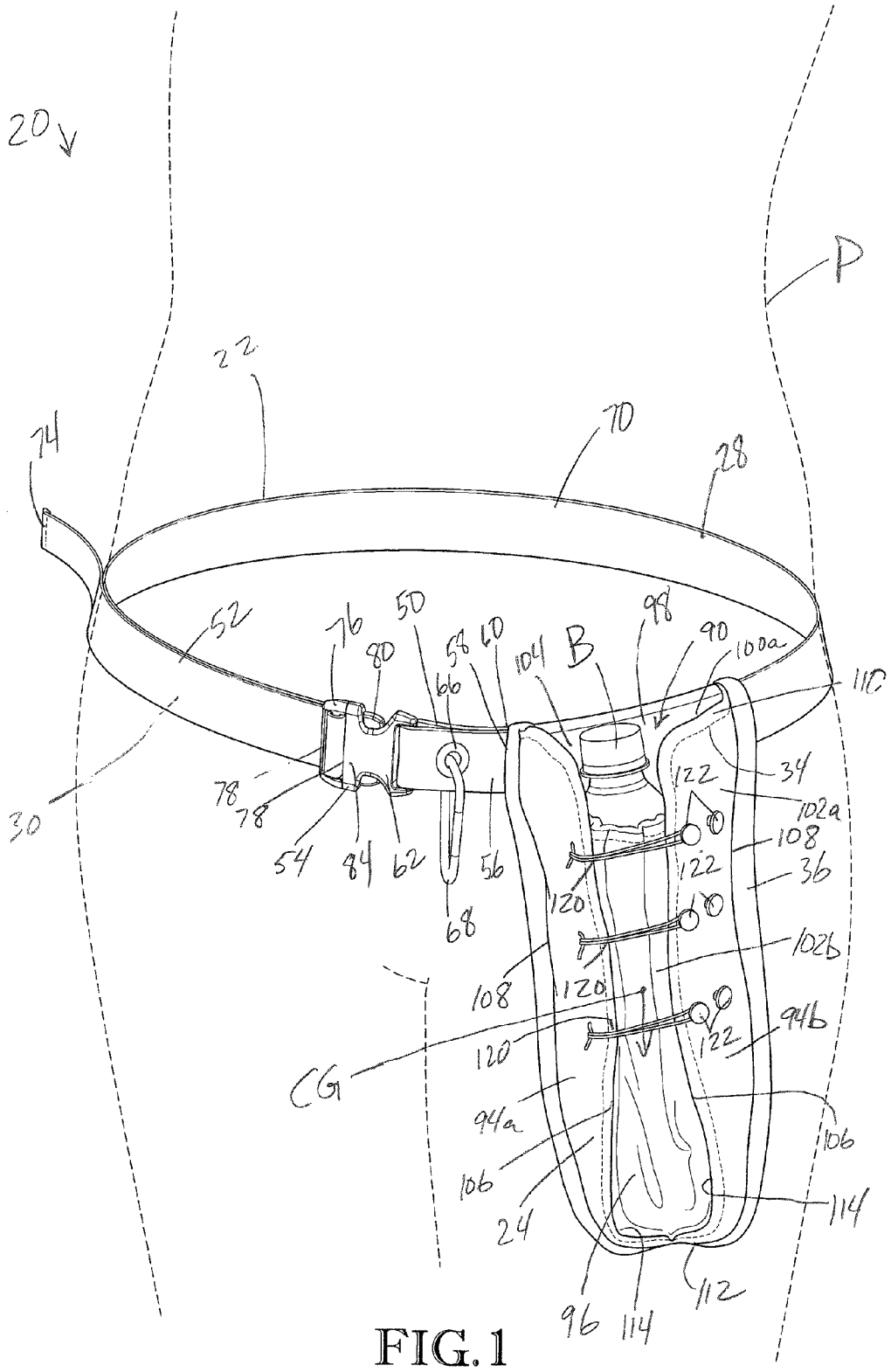
FIG. 1 is a perspective of a portable container holder constructed in accordance with a first preferred embodiment of the present invention, with the holder including a waist strap, a base wall, and an expandable sleeve, showing the holder snugly secured on a wearer, and with elastic connector loops of the sleeve attached to corresponding buttons to securely hold a bottle in the sleeve.
Figure 2:
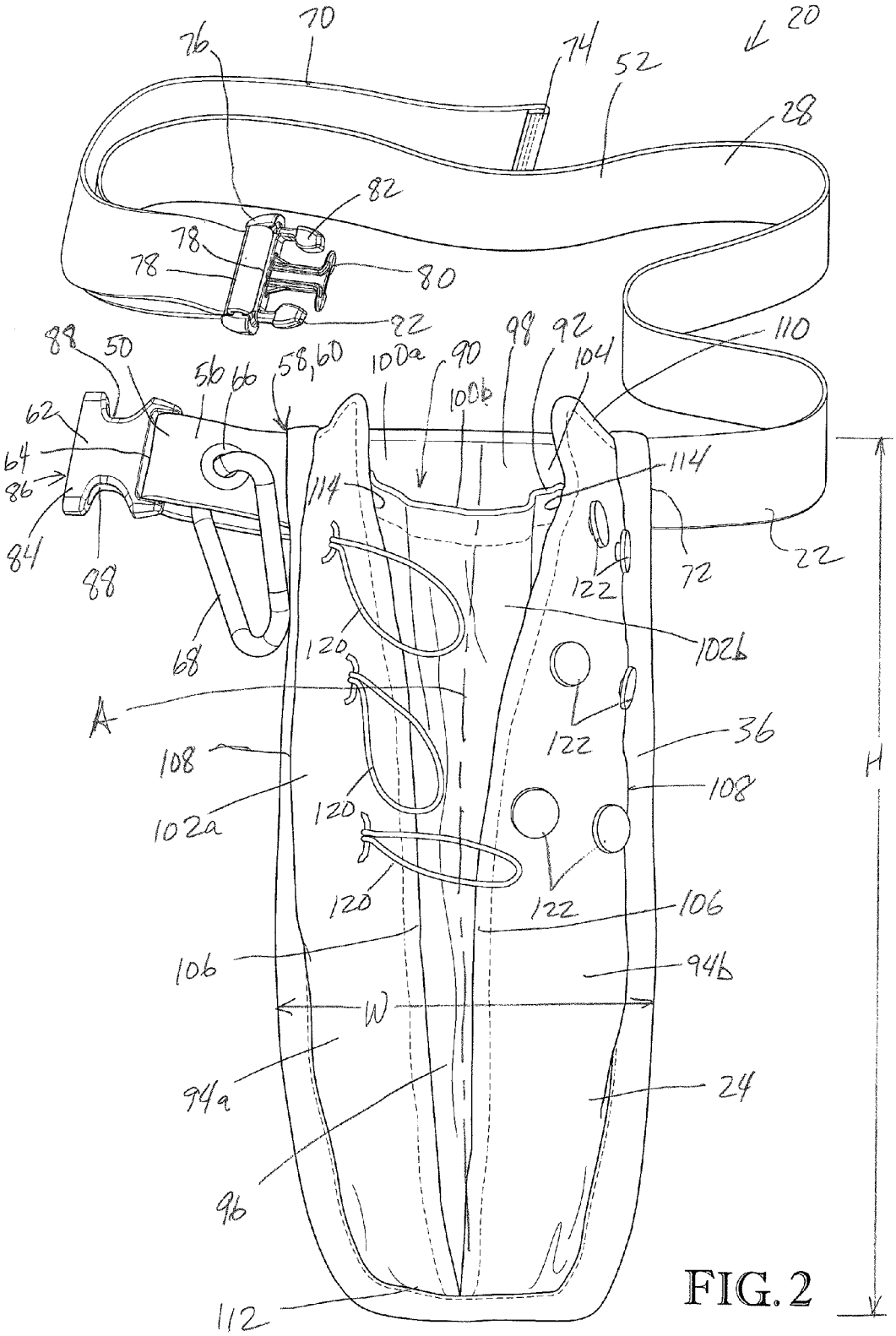
FIG. 2 is a perspective of the portable container holder shown in FIG. 1, showing the buckles of the waist strap detached from one another, and showing elastic connector loops of the sleeve detached from corresponding buttons, with the sleeve in an expanded position.

The front wall 96 also includes inner and outer layers 100*b*,102*b* but does not include an insulating layer between the layers 100*b*,102*b* (see FIG. 2). The inner layer 100*b* preferably includes a cloth material, although the inner layer 100*b* could include one or more alternative materials. The outer layer 102*b* preferably includes a continuous sheet of synthetic resin material, although the outer layer 102*b* could include one or more alternative materials. The walls 94,96, 98 cooperatively present an interior surface 104 that forms the container opening 90 when the sleeve 24 is in an unfolded condition.

The inner and outer layers 100,102 of the sleeve 24 cooperatively provide a nonpermeable liner for the sleeve 24. However, it is within the ambit of the present invention where the sleeve 24 does not include such a liner. The liner preferably includes a nonpermeable material that is either waterproof or water resistant, although the liner could be water permeable. While the liner material itself is preferably not insulated, the liner could include an insulating material.

The cloth material of layers 100*b*,102*a* preferably includes a 100% cotton fabric. However, the illustrated layers 100*b*,102*a*, the other layers of the sleeve 24, or any other flexible layered components of the holder 20 could also include polyester, nylon, rayon, blended fabric, ripstop, canvas, and/or other water resistant fabrics.

The side walls 94 are elongated and each present front and back side margins 106,108. The walls 94,96,98 cooperatively form upper and lower margins 110,112 of the sleeve 24, with the upper margin defining the open top 92 when the sleeve 24 is in the unfolded condition.

The sleeve 24 is preferably constructed so that the bottle B is inserted by sliding a lower end (not shown) of the bottle B downwardly through the open top 92 and into the opening 90 until the lower end is adjacent the lower margin 112 of the sleeve 24. The sleeve 24 also preferably permits removal of the bottle B by sliding the bottle B upwardly out of the opening 90. However, for some aspects of the present, the sleeve 24 could permit alternative insertion and/or removal of the bottle B. For instance, insertion and/or removal of the bottle B could involve at least some lateral movement of the bottle B relative to the sleeve axis A (e.g., where the front wall 96 extends only along a bottom portion of the sleeve 24).

The side walls 94 are preferably sewn to the back wall 98 and the base wall 26 along back side margins 108 and lower margins 112, with the front side margins 106 and the upper margins 110 being largely detached and movable relative to the back wall 98 and the base wall 26. The front wall 96 presents side edges 114 and is preferably sewn to the side walls 94 along corresponding side edges 114 (see FIG. 1). The lower margin 112 of the front wall 96 is preferably sewn to the side walls 94 and to the back wall 98 so that the bottom of the sleeve 24 is closed. However, the sleeve 24 could have an open bottom without departing from the scope of the present invention.

The side edges 114 are sewn to the side walls 94 so that the interior surface 104 of the front wall 96 engages the interior surfaces 104 of the front side margins 106. This construction urges the front wall 96 to move toward the back wall 98 as the front wall 96 folds onto itself.

The interior surface 104 of the sleeve 24 preferably presents a maximum height dimension that is substantially the same as the maximum height dimension H of the base wall 26. The interior surface 104 of the sleeve 24 also preferably presents a maximum width dimension that is substantially the same as the maximum width dimension W of the base wall 26. However, it is within the ambit of the present invention where the sleeve 24 is alternatively sized.

Again, the support structure 22 is preferably constructed so that the base wall 26 is positioned substantially entirely below the waist strap 28. With the sleeve 24 sewn to the base wall 26, the sleeve 24 also is preferably positioned entirely below the waist strap 28. This arrangement permits the holder 20 to support the bottle B in a secure and stable configuration. Specifically, for containers having a container height that is about the same as or less than the maximum height dimension of the sleeve 24 (such as the bottle B), the center of gravity CG of the container is spaced below the waist strap 28 when the container is fully inserted into the sleeve 24 (see FIG. 1). For containers with a container height greater than the maximum height dimension of the sleeve 24 but less than two times the height dimension of the sleeve 24, the center of gravity CG is preferably positioned below the waist strap 28 when the container is inserted into the sleeve 24. However, for some aspects of the present invention, the sleeve 24 could be alternatively vertically positioned relative to the waist strap 28.

While the sleeve 24 preferably includes the four (4) depicted walls, the sleeve 24 could have an alternative number of walls without departing from the scope of the present invention. For instance, the sleeve 24 could have three (3) or fewer walls (e.g., where the sleeve 24 is devoid of the back wall 98, with the back side margins 108 of side walls 94 being joined to one another). The sleeve 24 could also include a single continuous wall with side margins adjustably connected to one another. Yet further, the sleeve 24 could include more than four (4) walls.

Again, the base wall 26 is preferably sewn to the sleeve 24 and provides the sleeve with additional insulation and rigidity. Preferably, the sleeve 24 is sewn along substantially its entire height to the base wall 26 so that the sleeve 24 is fully supported by the base wall 26. While this attachment configuration between the sleeve 24 and the base wall 26 is preferred, the sleeve 24 and base wall 26 could be alternatively connected to one another, as will be shown in a subsequent embodiment.

The base wall 26 and the sleeve 24 are also sewn together to cooperatively form pockets 116,118 (see FIG. 3). The pockets 116,118 are defined by respective sewing lines 34 so that the pockets 116,118 are separated and do not communicate directly with each other. The openings 46,48 defined by the zipper connectors 42,44 provide user access to the pockets 116,118. The eyelet 99 also preferably presents an opening that provides access to the pocket 116 (e.g., to permit a headphone cord to extend into and out of the pocket 116).

When the walls 94,96,98 are sewn together, the front wall 96 flexes to permit the sleeve 24 to move between an expanded condition (see FIG. 2) and a collapsed condition (not shown). In the expanded condition, the interior surfaces 104 of the side walls 94,96,98 face in opposition to one another. Also, the front wall 96 is at least partly unfolded, with the interior surfaces 104 of the front and back walls 96,98 also facing in opposition to one another.

Also in the expanded condition, the interior surface 104 of the sleeve 24 preferably defines a maximum depth dimension D that ranges from about one-half inch (0.5") to about six inches (6") and, more preferably, ranges from about two inches (2") to about four inches (4"). The maximum depth dimension D of the sleeve 24 is preferably less than half of the maximum length dimension of the sleeve 24.

In the collapsed condition, the side margins 106,108 of the side walls 94 are positioned adjacent to one another. The front wall 96 is moved to a position adjacent the back wall 96 and is at least partly folded onto itself to permit collapsing of the side walls 94.

The sleeve 24 also preferably includes a series of elastic connector loops 120 and a series of buttons 122 that are removably attached to one another. The buttons 122 preferably comprise flat buttons, but could include another type of button (such as a shank button). The illustrated buttons 122 are mounted on the side wall 94*b* by sewing the buttons 122 with multiple loops of thread (not shown). Preferably, the buttons 122 are positioned to form two vertical lines 124 of buttons 122 on the side wall 94*b* (see FIG. 4). This configuration permits each connector loop 120 to be secured on one of two corresponding buttons 122. That is, the connector loops 120 can be secured in one of two attachment positions relative to the side wall 94*b*.

However, it will be appreciated that the arrangement of buttons 122 could be alternatively configured. For instance, the buttons 122 could be arranged in three or more vertical lines spaced along the side wall 94*b* to provide three or more attachment positions for each of the connector loops 120. The buttons 122 could also be configured to form a single vertical line.

The connector loops 120 each preferably include an elongated elastic cord that is looped onto itself. The illustrated loops 120 are mounted on side walls 94*a* by securing the ends of the elastic cords to the side wall 94*a*. The loops 120 are preferably elastically stretchable from a relaxed length to a stretched length that is at least about twice the relaxed length.

When detached from one another, the loops 120 and buttons 122 permit the sleeve 24 to move between the expanded and retracted conditions (see e.g., FIG. 2). When the buttons 122 and loops 120 are connected to one another, the loops 120 urge the side walls 94 to move toward one another (see FIG. 1). That is, the loops 120 urge the side walls 94 toward the collapsed condition.

The attachment of one or more of the loops 120 to corresponding buttons 122 preferably causes the walls 94,96,98 to cooperatively grasp and hold the bottle B in frictional engagement. However, the sleeve 24 could have one or more alternative elastic members, such as an elastic strap, to selectively connect and urge the side walls 94 toward one another.

While the loops 120 and buttons 122 are preferred to selectively adjust the size of the sleeve 24, it is within the ambit of the present invention to use alternative connectors. For example, the sleeve 24 could include metal or plastic zippers, metal or plastic snaps, hook-and-loop material, metal or plastic buckles, and/or metal or plastic clasps to selectively position the side walls 94 for securing a container.

The illustrated holder 20 preferably includes a single sleeve 24 supported by the base wall 26. However, it is within the scope of the present invention where the holder 20 includes multiple discrete sleeves (e.g., where a series of sleeves 24 are mounted side-by-side to provide multiple container openings 90).

In use, the wearer P can selectively don the holder 20 by positioning the holder 20 at waist level. If the buckles 62,76 happen to be connected before the holder 20 is donned, the buckles 62,76 are detached. With the buckles 62,76 detached, the waist strap 28 is wrapped around the waist so that the buckles 62,76 are located adjacent to one another. The holder 20 can then be secured by snapping the buckles 62,76 into engagement with one another. If necessary, any slack in the waist strap 28 can be removed by pulling the end 74 away from the buckle 76 to provide a snug fit between the waist band 30 and the wearer's waist. The wearer P can selectively remove the holder 20 by detaching the buckles 62.76 from one another.

The wearer P can selectively secure the bottle B in the holder 20 by inserting the bottle B into the opening 90.

Specifically, the bottle B is preferably inserted by sliding a lower end (not shown) of the bottle B downwardly into the opening until the lower end is adjacent the lower margin 112 of the sleeve 24. If one or more of the loops 120 are attached to buttons 122 prior to inserting the bottle B, the attached loops 120 are preferably detached prior to bottle insertion. The wearer P can then secure the bottle B in the sleeve 24 by selectively attaching one or more of the loops 120 to corresponding buttons 122 to urge the side walls 94 toward one another. In this manner, the walls 94,96,98 cooperatively grasp and hold the bottle B in frictional engagement. To remove the bottle B from the sleeve 24, the loops 120 are preferably detached from buttons 122 to permit the bottle B to slide in an upward direction until the bottle B is spaced above the sleeve 24.

Turning to FIGS. 5-15, alternative preferred embodiments of the present invention are depicted. For the sake of brevity, the remaining description will focus primarily on the differences of these alternative embodiments from the preferred embodiment described above.

Initially turning to FIGS. 5-11, an alternative holder 200 is constructed in accordance with a second preferred embodiment of the present invention. The holder 200 preferably includes an alternative support structure 202 and an alternative expandable sleeve 204.

The support structure 202 is used to removably secure the holder 200 onto a wearer P. The illustrated support structure 202 preferably includes a base wall 206, and a shoulder strap 208.

The base wall 206 has a unitary construction and preferably includes inner and outer cloth layers 210,212 (see FIGS. 7 and 8) and an insulating layer (not shown) sewn between the cloth layers 210,212. While the layers 210,212 preferably include a cloth material, the inner layer 210 and/or the outer layer 212 could include one or more alternative materials. As discussed below, The illustrated holder 200 has an alternative attachment configuration to connect the sleeve 204 and the base wall 206. Specifically, a lower portion 206*a* of the base wall 206 is sewn to the sleeve 204, and an upper portion 206*b* of the base wall 206 is removably attached to the sleeve 204 with connectors 214,216 of the holder 200.

The illustrated base wall 206 is elongated and presents upper and lower ends 218,220. The support structure 202 also preferably includes an expandable pouch 222, a flap 224, a connector loop 226, and a button 228 (see FIG. 8). The pouch 222 and flap 224 include cloth material and are sewn to the rear surface of the base wall 206. Preferably, the loop 226 is attached to the flap 224, and the button 228 is attached to the pouch 222. Thus, the loop 226 and the button 228 can be selectively attached to each other to close the pouch 222. The base wall 206, pouch 222, and flap 224 cooperatively form an enclosed pocket 230 (see FIG. 8).

The shoulder strap 208 is operable to removably secure the holder 200 onto the wearer P. The shoulder strap 208 preferably includes strap sections 232,234, strap adjusters 236,238, and snap connectors 240,242.

The strap section 232 includes a reinforcing layer (not shown) and cloth layers 244 sewn to cover the reinforcing layer. The strap section 232 is elongated and presents one end 246 sewn to the upper end 218 of the base wall 206 and an opposite loop end 248 attached to the strap adjuster 236.

The strap section 234 also includes a reinforcing layer (not shown) and cloth layers 250 sewn to cover the reinforcing layer. The strap section 234 is also elongated and presents a loop end 252 (see FIG. 5) and an opposite connector end 254 (see FIG. 8). The loop end 252 is attached to the strap adjuster 238. The connector end 254 of the strap section 234 is threaded through an opening 256 (see FIG. 6) of the strap adjuster 236 and through openings 258 (see FIG. 5) of the strap adjuster 238.

Figure 8:
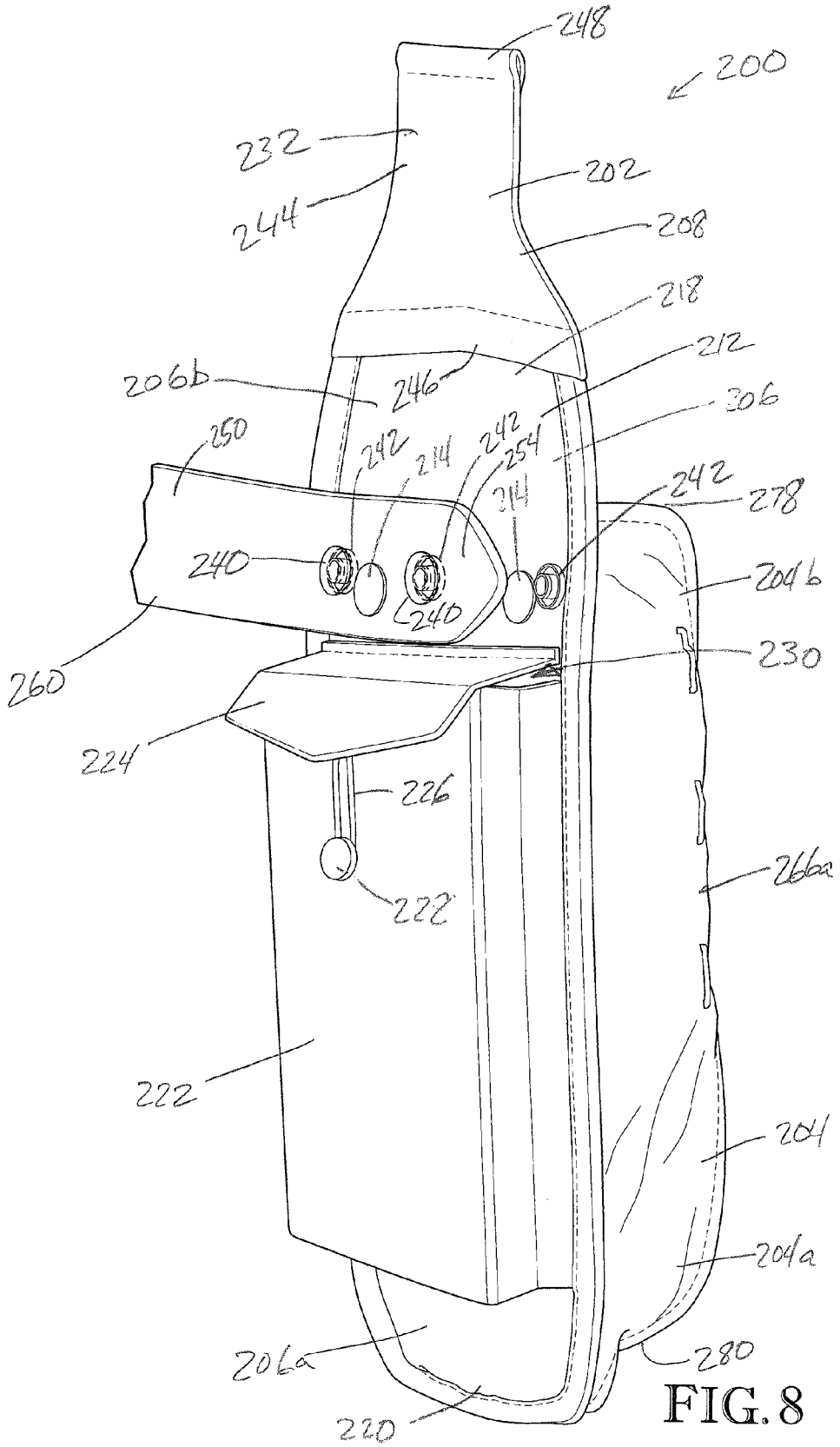
FIG. 8 is a fragmentary rear perspective of the portable container shown in FIGS. 5-7, showing an enclosed pouch attached to the base wall and a shoulder strap removably attached to the base wall with snaps.
Figure 9:
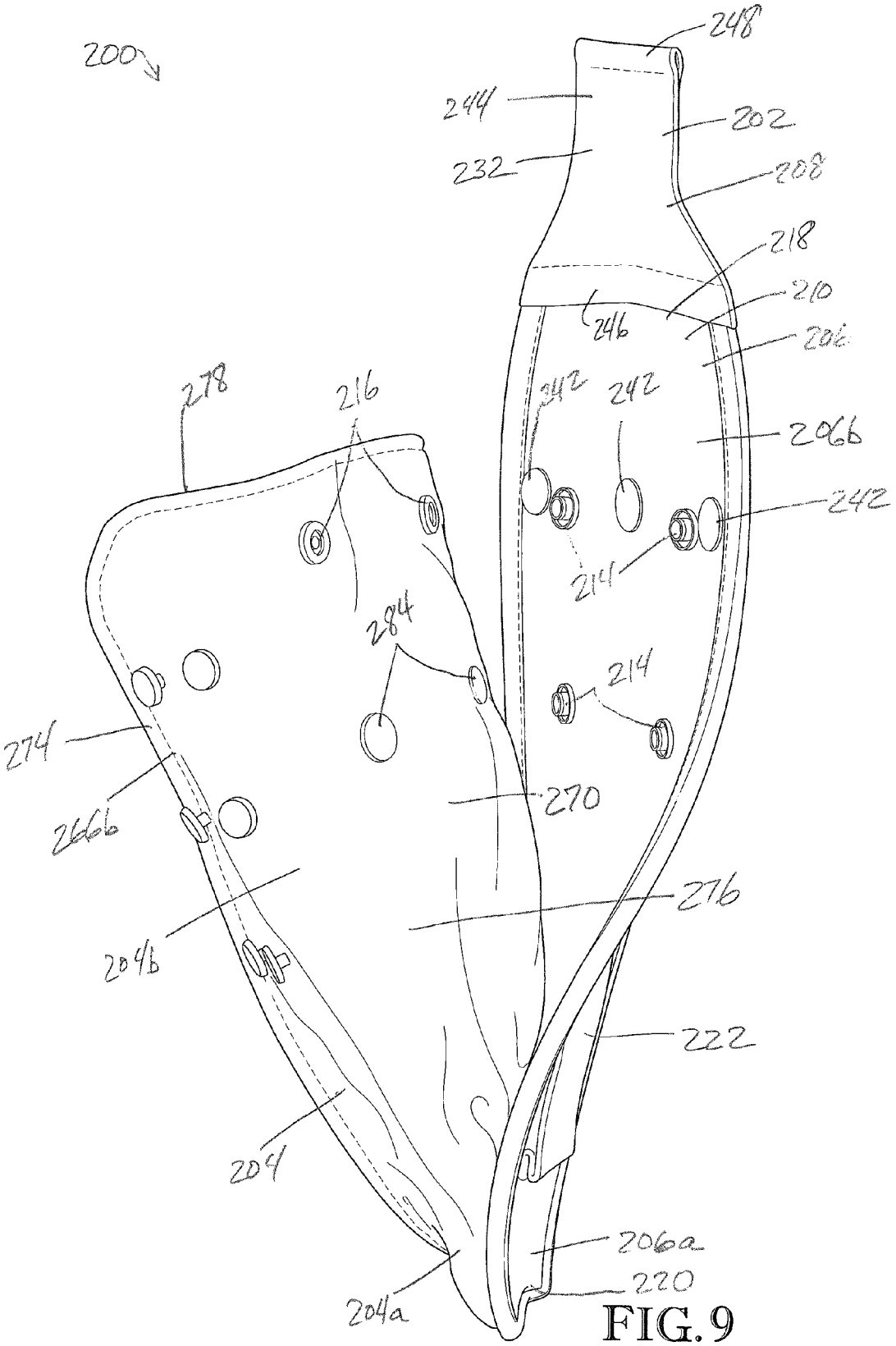
FIG. 9 is a fragmentary front perspective of the portable container shown in FIGS. 5-8, showing snaps mounted on the sleeve and the base wall to removably connect the sleeve and base wall to one another, with the snaps being detached to permit an upper portion of the sleeve to be removed from the base wall.

A pair of snap connectors 240 are attached to the strap section 234 adjacent to the connector end 254 (see FIG. 8). Three (3) snap connectors 242 are attached to base wall 206 (see FIG. 9). The snap connectors 242 are arranged in series so that the snap connectors 240 can be removably attached to either pair of adjacent snap connectors 242. Also, the connector end 254 can preferably be attached to the base wall 206 so that the strap section 234 can extend laterally from the base wall 206 in either of two lateral directions (see FIGS. 8 and 10). It has been found that these connector orientations permit the holder 200 to be comfortably worn on either shoulder of the wearer P.

While the illustrated holder 20 includes the snap connectors 240,242 to removably attach the strap section 234 to the base wall 206, the holder 20 could use alternative connectors to provide removable attachment. For instance, the holder 20 could include a male buckle similar to buckle 76 (but smaller in size) attached to the strap section 234 and a pair of female buckles similar to buckle 62 (but smaller in size) attached to the back of the base wall 206. Specifically, the female buckles could be attached to the base wall 206 so as to face in opposite lateral directions, with each female buckle being configured to be removably attached to the male buckle. Yet further, the holder 20 could include one or more other types of connectors to removably secure the strap section 234 to the base wall 206.

With snap connectors 240 removably connected to corresponding snap connectors 242, the shoulder strap 208 and the base wall 206 cooperatively form an endless shoulder band 260 to be secured on the wearer P for supporting the holder 200. Preferably, the snap connectors 240,242 can be selectively disconnected (e.g., to permit adjustment of the shoulder band 260).

The strap adjuster 238 is operable to be moved along the strap section 234 to change the length of the shoulder band 260. For instance, the strap adjuster 238 can be moved toward the connector end 254 to shorten the shoulder band 260. Conversely, the strap adjuster 238 can be moved away from the connector end 254 to lengthen the shoulder band 260.

While the illustrated band 260 is preferably slung about the shoulder of the wearer P, it is within the ambit of the present invention for the band 260 to be used in various other carry arrangements. For instance, the illustrated strap 208 could be shortened for use as a waist strap where the holder 200 is worn snugly about the waist. It will also be appreciated that the strap 208 could be secured around the handle of a bag, briefcase, purse, tote, luggage, etc.

Figure 7:
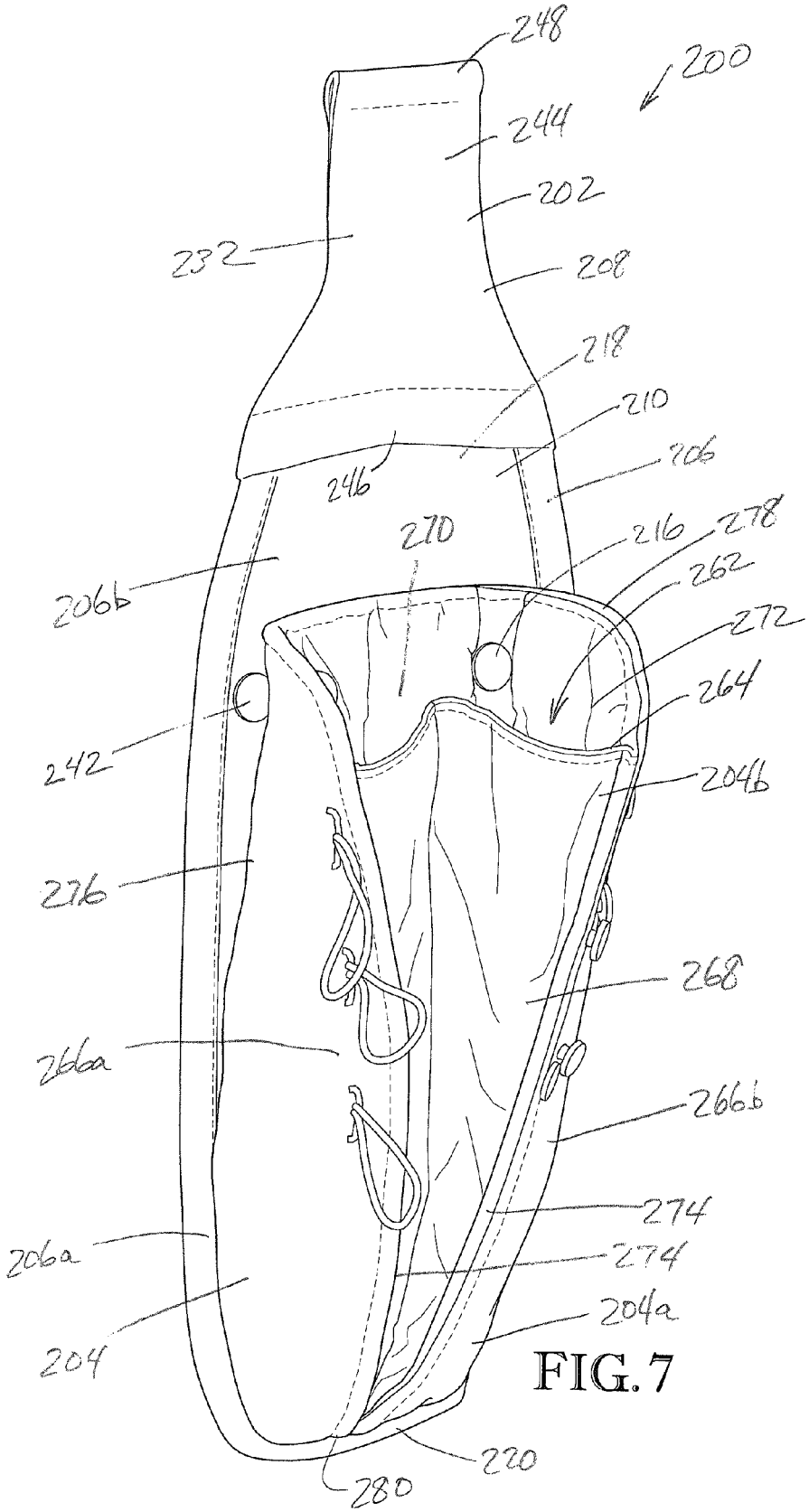
FIG. 7 is a fragmentary perspective of the portable container shown in FIGS. 5 and 6, showing the connector loops detached and the sleeve in an expanded position, and showing the bottle removed from the sleeve.

Still referring to FIGS. 5-11, the sleeve 204 is expandable and presents an elongated container opening 262 and an open top 264 that communicates with the opening 262 (see FIG. 7). The sleeve 204 preferably includes side walls 266*a,b*, front wall 268, and back wall 270 that form lower and upper portions 204*a,b* of the sleeve 204 (see FIG. 7). The walls 266,268,270 cooperatively present an interior surface 272 that forms the container opening 262 when the sleeve 204 is in an unfolded condition.

The side walls 266 are elongated and each present front and back side margins 274,276. The walls 266,268,270 cooperatively form upper and lower margins 278,280 of the sleeve 204, with the upper margin 278 defining the open top 264 when the sleeve 204 is in the unfolded condition.

Again, the sleeve 204 and base wall 206 of the illustrated holder 200 have an alternative attachment configuration. In particular, the lower portion 206*a* of the base wall 206 is sewn to the sleeve 204, and an upper portion 206*b* of the base wall 206 is removably attached to the sleeve 204 with connectors 214,216 of the holder 200. Connectors 214 are attached to the base wall 206, and connectors 216 are attached to the back wall 270 of the sleeve 204.

When the connectors 214,216 are removably attached to one another, the base wall 206 and the back wall 270 are positioned alongside one another and are substantially coextensive with one another. When the connectors 214,216 are detached from one another, the upper portion 206*b* can be detached and moved relative to the back wall 270.

Figure 10:
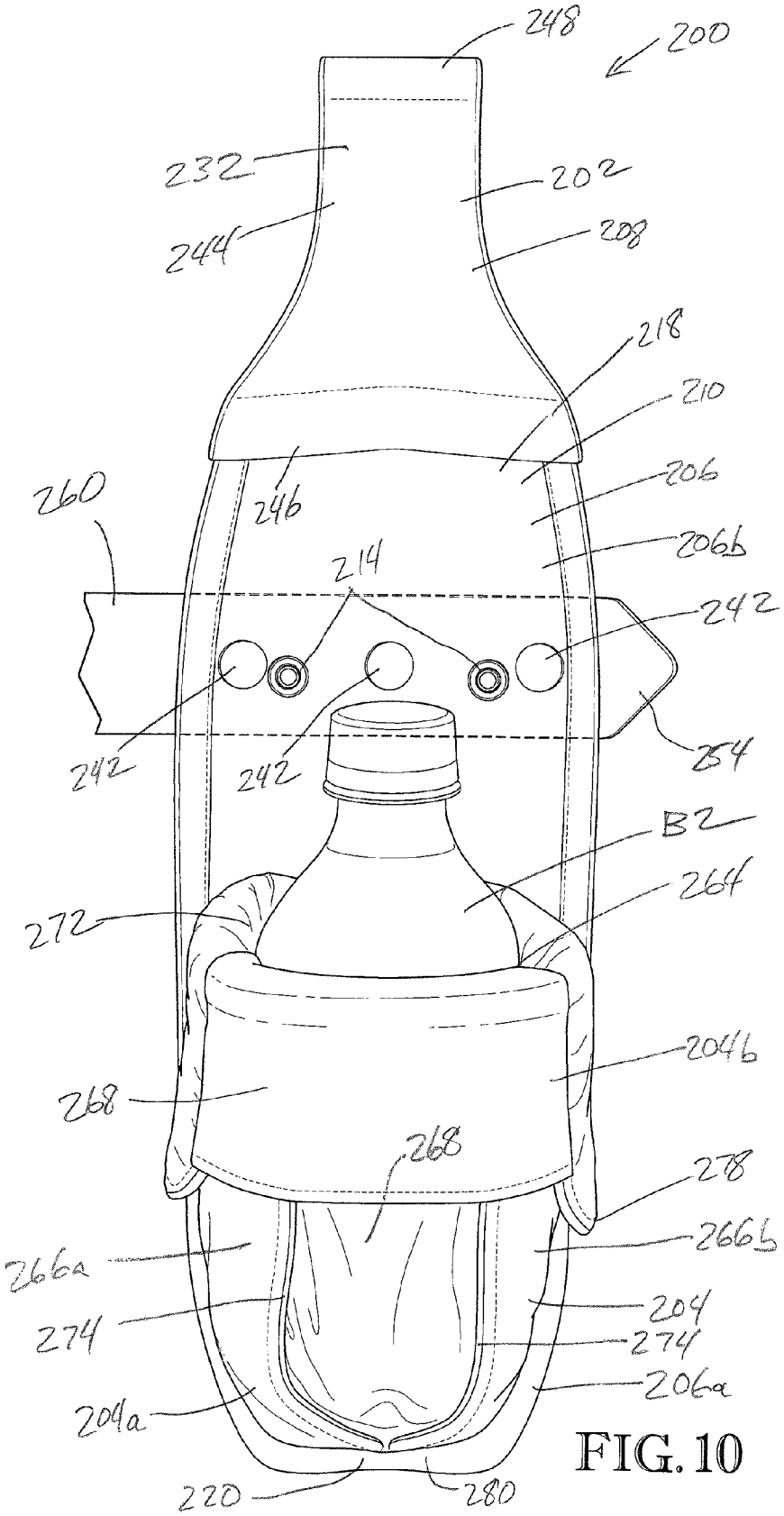
FIG. 10 is a fragmentary front elevation of the portable container shown in FIGS. 5-9, showing the upper portion of the sleeve folded downwardly toward a lower portion of the sleeve, with the folded portion of the sleeve being removably attached to the base wall.
Figure 11:
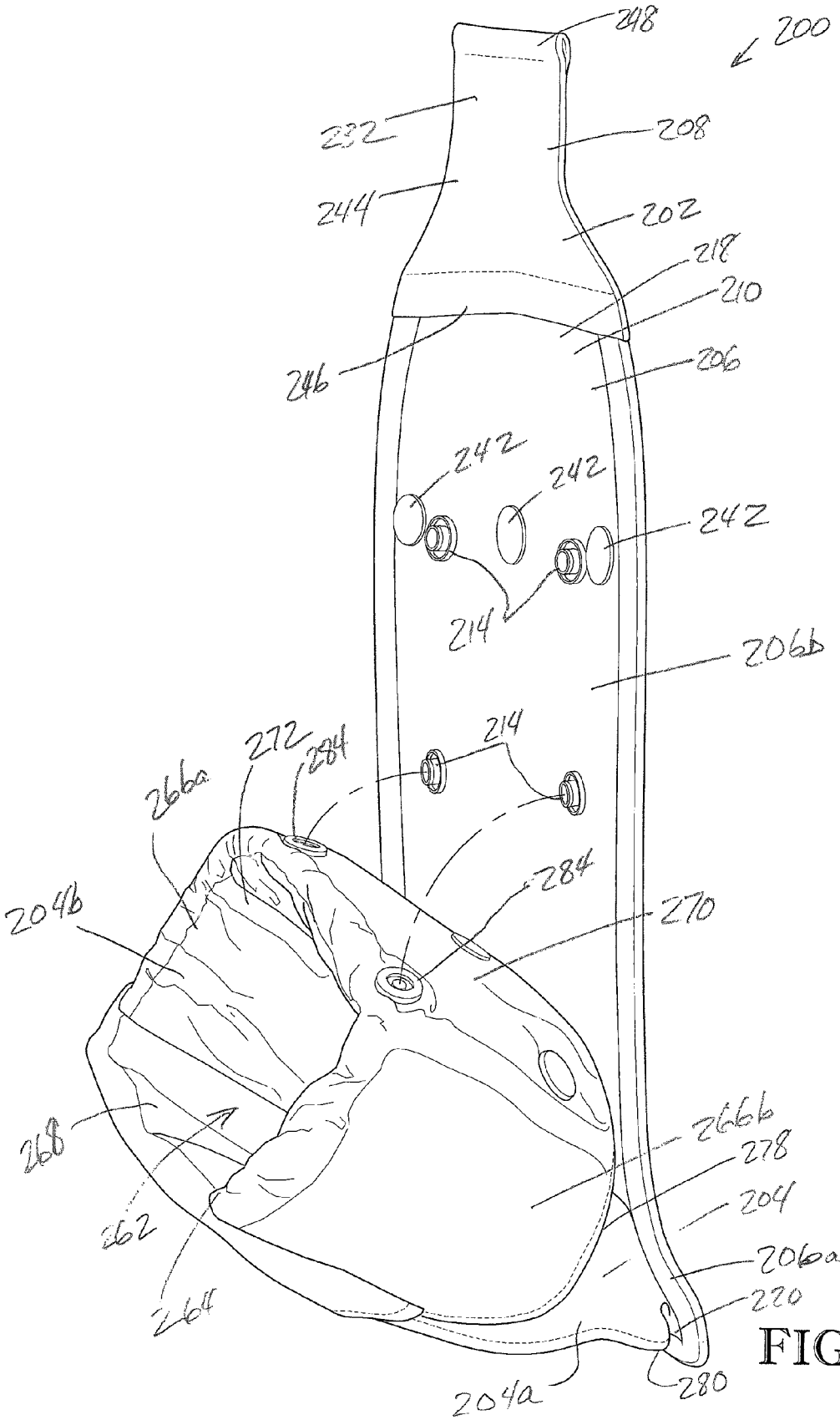
FIG. 11 is a fragmentary front perspective of the portable container similar to FIG. 9, but showing the upper portion of the sleeve folded downwardly, with snaps on an interior surface of the upper portion of the sleeve being exposed for attachment to corresponding snaps on the base wall.

The illustrated sleeve 204 can preferably be adjusted between an unfolded condition (see FIGS. 5-7) and a folded condition (see FIGS. 10 and 11). In the unfolded condition, the sleeve 204 presents an unfolded sleeve height that defines the opening length. In the folded condition, the upper portion 204*b* of the sleeve 204 is folded downwardly toward the lower portion 204*a*. In this position, the open top 264 is lowered from the unfolded condition. Thus, when the sleeve 204 is adjusted to the folded condition, the opening length is reduced from the unfolded condition.

This collapsing adjustment of the sleeve 204 enables the holder 200 to conveniently receive a smaller container (such as bottle B2) when the sleeve 204 is folded (see FIG. 10). While this collapsing mechanism is preferred, the sleeve 204 could have an alternative collapsing mechanism. For instance, the sleeve 204 could have upper and lower portions that are not integrally formed with each other but are in telescopic sliding engagement with one another.

The holder 200 further includes connectors 284 that are removably attachable to connectors 214 of the base wall 206 to selectively secure the sleeve 204 in the folded condition (see FIG. 11). Specifically, when the sleeve 204 is in the folded condition, the connectors 284 are exposed for removable attachment to the connectors 214. However, it will be appreciated that the holder 200 could have an alternative structure to selectively secure the sleeve 204 in the folded condition.

Figure 12:
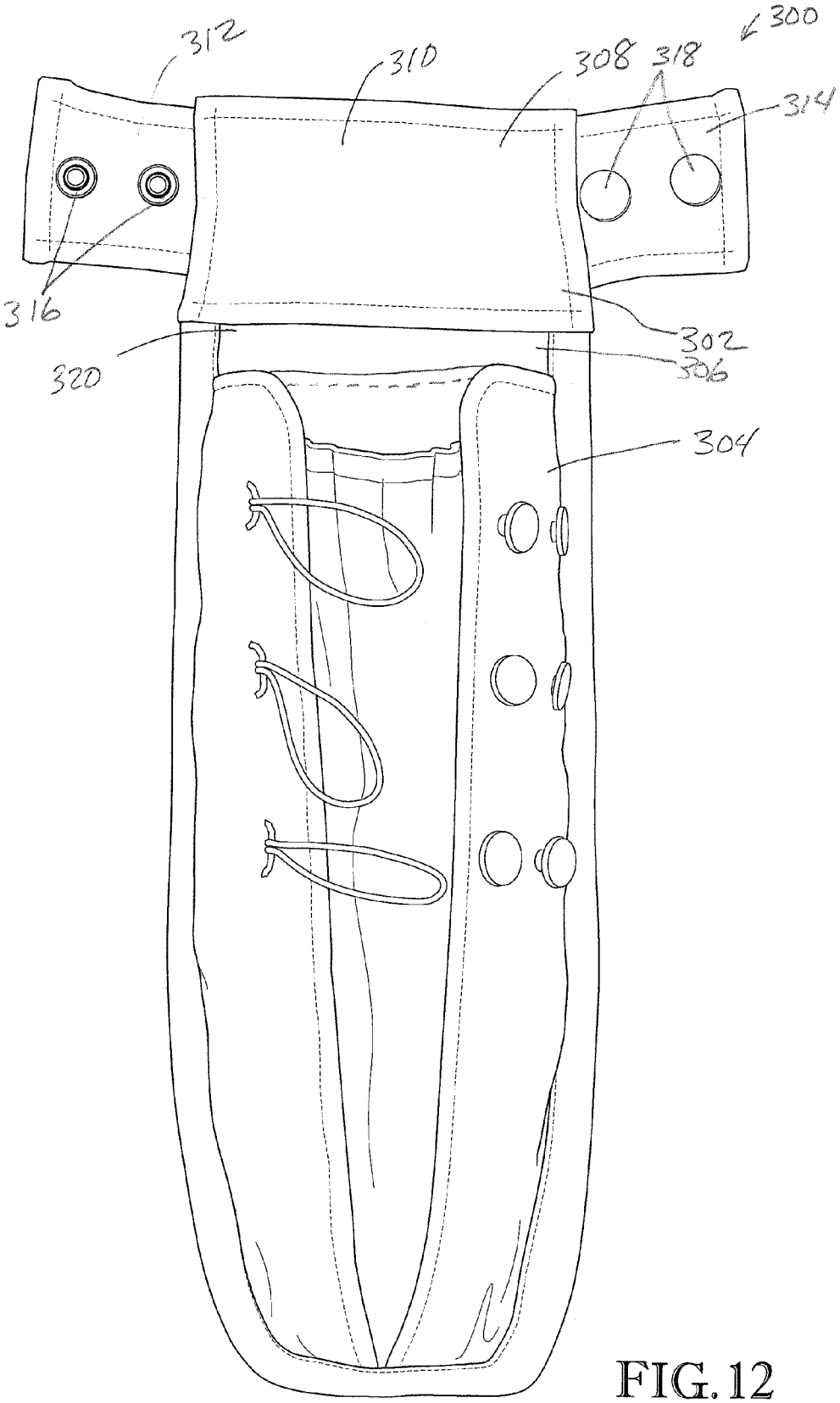
FIG. 12 is a front elevation of a portable container holder constructed in accordance with a third preferred embodiment of the present invention, with the holder including a luggage strap, a base wall, and an expandable sleeve, showing strap sections of the luggage strap detached from one another.
Figure 13:
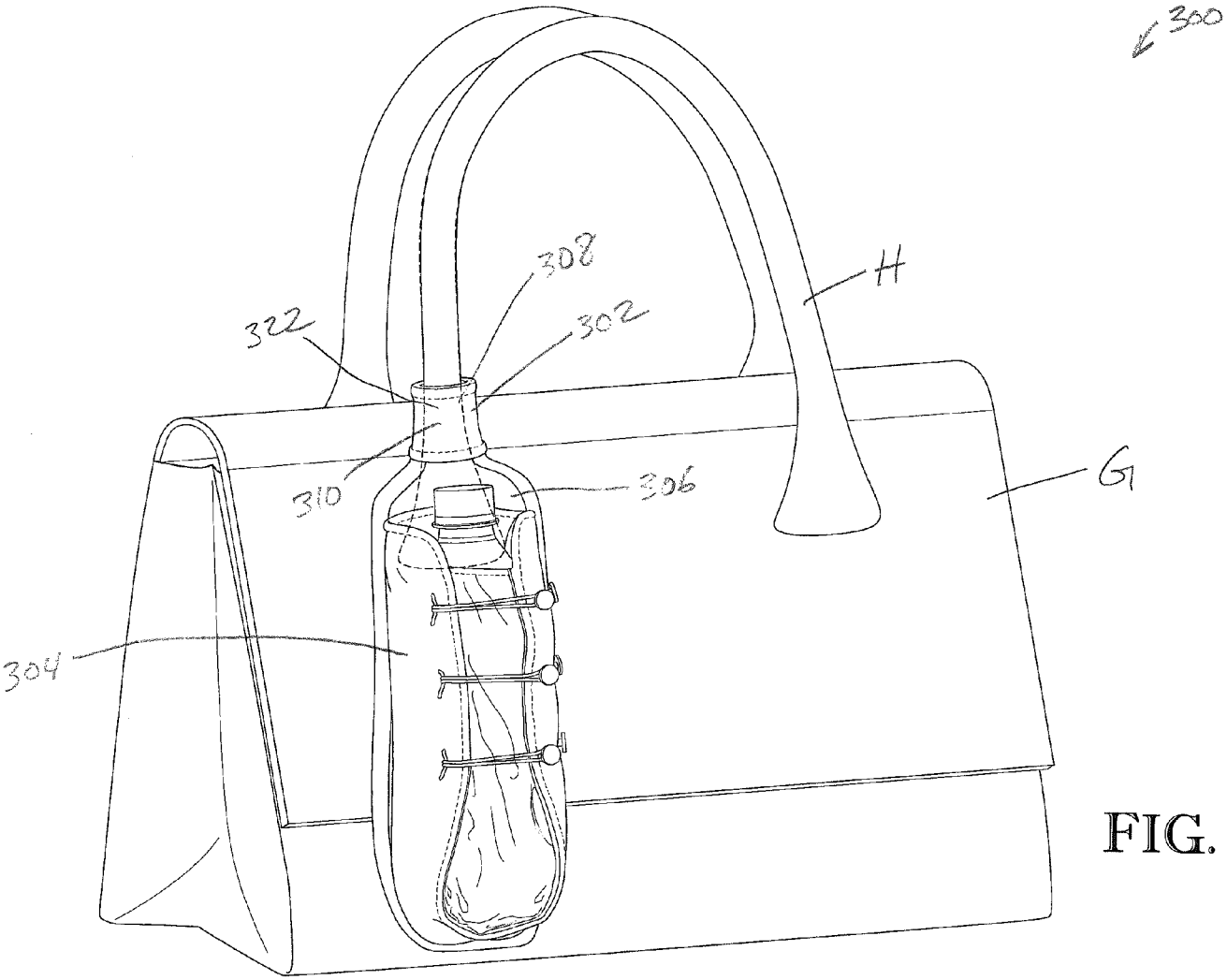
FIG. 13 is a perspective of the portable container holder shown in FIG. 12, showing the holder mounted on a bag by wrapping the strap sections around the handle of the bag and attaching snaps of the strap sections to one another.

Turning to FIGS. 12 and 13, an alternative holder 300 is constructed in accordance with a third preferred embodiment of the present invention. The holder 300 preferably includes an alternative support structure 302 and an expandable sleeve 304. The support structure 302 is used to removably secure the holder 300 onto a wearer and includes a base wall 306 and a handle strap 308.

The handle strap 308 preferably includes a strap base 310, strap sections 312,314, and snap connectors 316,318. The strap base 310 and strap sections 312,314 each include a cloth material and are sewn to one another to provide a unitary and flexible structure. The strap base 310 is preferably sewn to an upper end 320 of the base wall 306 to support the base wall 306.

The snap connectors 316,318 are fixed to respective strap sections 312,314 and are removably connectable to one another. With snap connectors 316 removably connected to corresponding snap connectors 318, the handle strap 308 forms an endless band 322 to be secured on the handle of an object, such as the handle H of bag G (see FIG. 13). The snap connectors 316,318 can be selectively disconnected to permit the holder 200 to be secured to or removed from the handle H.

However, the holder 300 could include alternative connectors to removably attach the strap sections 312,314 to one another. For instance, the holder 300 could include male and female buckles removably attachable to one another. In particular, a male buckle similar to buckle 76 (but smaller in size) attached to the strap section 312 and a female buckle similar to buckle 62 (but smaller in size) attached to the strap section 314. Furthermore, the holder 300 could include one or more other types of connectors to removably secure the strap section 312,314.

Turning to FIG. 14, an alternative holder 400 is constructed in accordance with a fourth preferred embodiment of the present invention. The holder 400 preferably includes an alternative support structure 402 and an expandable sleeve 404. The support structure 402 is used to removably secure the holder 400 onto a wearer and includes a base wall 406, a mounting clip 408, and a fastener 410.

The mounting clip 408 is unitary and includes front and back plate sections 412,414 that are integrally formed with each other. The plate sections 412,414 are joined by a curved section 416 and present respective openings 418,420. The illustrated clip 408 preferably includes a metal material, such as carbon alloy steel or stainless steel. However, the clip 408 could also include a synthetic resin material.

The clip 408 is fixed to the sleeve 404 and the base wall 406 by inserting the fastener 410 through the opening 418 of the front plate section 412 and through a back wall 422 of the sleeve 404. The base wall 406 and the clip 408 cooperatively form a slot 424. The base wall 406 and clip 408 can be slidably received on various thin wall structures, such as a belt T, by inserting at least an upper margin of the wall structure into the slot 424. Thus, the base wall 406 and clip 408 cooperatively provide removable frictional attachment of the support structure 402 to the belt T or other wall structure.

Turning to FIG. 15, an alternative holder 500 is constructed in accordance with a fifth preferred embodiment of the present invention. The holder 500 preferably includes a support structure 502 and a preferred expandable sleeve 504. The support structure 502 is used to removably secure the holder 500 onto a wearer and includes a base wall 506 and a waist strap 508.

The sleeve 504 preferably includes side walls 510*a*,*b*, front wall 512, and back wall 514. The walls 510,512,514 cooperatively present an interior surface 516 that forms a container opening 518. The illustrated sleeve 504 also preferably includes a pair of elongated eyelets 520 and a pair of adjustment straps 522. The depicted eyelets 520 are secured to side wall 510*a* so that the eyelets 520 are vertically spaced from each other. It will be appreciated that the eyelets 520 could alternatively be secured to the other side wall 510*b*

Each strap 522 is preferably elongated and includes a cloth strip 523, a loop material strip 524 sewn adjacent to one end 526 of the strap 522, and a hook material strip 528 sewn adjacent to the other end 530 of the strap 522. The end 526 of the strap 522 is sewn to the side wall 510*b*, with the end 530 being removably attachable to the loop material strip 524. However, it is within the scope of the present invention where the end 530 is sewn to the side wall 510*b*, with the end 526 being removably attachable to the hook material strip 528. Furthermore, it is within the scope of the present invention where one or both of the straps 522 are sewn to the other side wall 510*a* (e.g., where corresponding eyelets 520 are secured to the other side wall 510*b*). While the illustrated holder 500 preferably includes a pair of straps 522 the holder 500 could include an alternative number of straps 522 to connect the side walls 510 (e.g., where the holder 500 has a single strap 522 or more than two straps 522). For some aspects of the present invention, the holder 500 could be devoid of straps 522.

The ends 530 of the straps 522 are removably inserted through respective eyelets 520 so that the straps 522 cooperatively slidably engage the side wall 510*a*. Each end 530 can be moved toward or away from the respective eyelet 520 to permit movement of the side walls 510 away from each other or to urge the side walls 510 toward each other. When the end 530 is in a desired position, the end 530 can be removably attached to the loop material strip 524 to removably and adjustably secure the side walls 510 relative to each other. In this manner, each strap 522 is operable to selectively reduce or enlarge the size of the opening 518 as the wearer desires. The end 530 of each strap 522 can be selectively removed from and reattached to the corresponding loop material strip 524 (e.g., to selectively adjust the size of the opening 518 and then to secure the side walls 510 to one another).

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of the present invention as pertains to any apparatus not materially departing from but outside the literal scope of the invention as set forth in the following claims.

What is claimed is:

1. A portable container holder operable to receive a handheld drink container, said portable container holder comprising:

a support structure operable to support the portable container holder while being transported, a flexible sleeve presenting an elongated opening to slidably receive the drink container and defining a sleeve axis along which the drink container slides into and out of the sleeve, said support structure including a unitary base wall that extends along the length of the sleeve and is operable to be secured relative to a wearer;

said sleeve defining a cross-sectional opening dimension transverse to the sleeve axis, said flexible sleeve including a unitary panel with a back wall portion and side wall portions on opposite sides of the back wall portion, wherein the back wall portion is attached to the base wall and the side wall portions project away from the base wall to wrap around the opening so that the sleeve is operable to grasp the drink container, said flexible sleeve including a flexible front wall that interconnects the side wall portions, with the front wall being shiftable to permit the side wall portions to be moved toward and away from one another to adjust the size of the cross-sectional dimension, said side wall portions presenting a pair of side margins that extend along the sleeve axis; and a sleeve connector that removably interconnects the side wall portions to position the side margins adjacent to one another, said sleeve defining a sleeve height along the sleeve axis, said back wall portion spaced from the side margins and extending along the sleeve axis, with the back wall portion and the base wall being attached to one another along substantially the entire sleeve height.

2. The portable container holder as claimed in claim 1, said sleeve connector including an elastic member that is stretchable to permit limited lateral movement of the side margins away from one another.

3. The portable container holder as claimed in claim 1, said sleeve presenting an interior surface that at least partly defines the elongated opening, with the front wall being attached to the interior surface of each side wall.

4. The portable container holder as claimed in claim 3, said front wall presenting opposite side edges and part of the interior surface extending between the side edges, said side edges of the front wall being attached to respective side walls so that the interior surface of the front wall along the side edges faces the interior surface of the side margins.

5. The portable container holder as claimed in claim 4, said side edges of the front wall being attached adjacent to the side margins of the side walls.

6. The portable container holder as claimed in claim 4, said sleeve presenting a lowermost margin, with the side walls being secured relative to one another adjacent the lowermost margin to close a lowermost end of the opening.

7. The portable container holder as claimed in claim 1, said sleeve presenting a lowermost margin, with the side walls being secured to the back wall portion adjacent the lowermost margin to close a lowermost end of the opening.

8. The portable container holder as claimed in claim 1, said support structure including an elongated strap secured to the base wall and operable to be secured on a wearer.

9. The portable container holder as claimed in claim 1, said sleeve defining an opening length along which the drink container slides into and out of the sleeve, said sleeve being adjustably attached to the support structure, with at least part of the sleeve being collapsible along the sleeve axis to reduce the size of the opening length.

10. A portable container holder operable to receive a handheld drink container, said portable container holder comprising:

a support structure operable to support the portable container holder while being transported; and a flexible sleeve including opposite side walls that cooperatively present an elongated opening to slidably receive the drink container, said sleeve defining a sleeve axis along which the drink container slides into and out of the sleeve and forming an opening length measured along the sleeve axis, said sleeve being adjustably attached to the support structure, with at least part of the sleeve being axially foldable along the sleeve axis to reduce the size of the opening length, said sleeve being adjustable between an unfolded condition where the sleeve presents an unfolded sleeve length that defines the opening length and a folded condition where at least a portion of the sleeve is folded axially onto another portion of the sleeve to reduce the opening length from the unfolded condition, a first pair of connectors mounted on the base wall and the sleeve to removably interconnect the base wall and the sleeve in the unfolded condition; and a second pair of connectors mounted on the base wall and the sleeve and spaced below the first pair of connectors to removably interconnect the base wall and the sleeve in the folded condition.

11. The portable container holder as claimed in claim 10, said support structure including a base wall that extends along the length of the sleeve and supports the sleeve, said side walls cooperatively presenting upper and lower portions of the sleeve, with the lower portion being fixed to the base wall and the upper portion being removably attached to the base wall, said upper portion being foldable from the unfolded condition toward the lower portion to reduce the opening length.

12. The portable container holder as claimed in claim 11, said sleeve including a back wall interconnecting the side walls and extending alongside the base wall, with the connectors associated with the sleeve being attached to the back wall.

13. The portable container holder as claimed in claim 11, said support structure including an elongated strap secured to the base wall and operable to be secured on a wearer.

14. The portable container holder as claimed in claim 10, said side walls presenting a pair of side margins that extend along the sleeve axis; and a sleeve connector that removably interconnects the side walls to position the side margins adjacent to one another.

15. The portable container holder as claimed in claim 14, said sleeve connector including an elastic member that is stretchable to permit limited lateral movement of the side margins away from one another.

16. The portable container holder as claimed in claim 14, said flexible sleeve including a flexible front wall that interconnects the side walls, with the front wall cooperating with the side walls to present the elongated opening, said sleeve presenting an interior surface that at least partly defines the elongated opening, with the front wall being attached to the interior surface of each side wall.

17. The portable container holder as claimed in claim 16, said front wall presenting opposite side edges and part of the interior surface extending between the side edges, said side edges of the front wall being attached to respective side walls so that the interior surface of the front wall along the side edges faces the interior surface of the side margins.

18. The portable container holder as claimed in claim 17, said side edges of the front wall being attached adjacent to the side margins of the side walls.

19. The portable container holder as claimed in claim 17, said sleeve presenting a lowermost margin, with the side walls being secured relative to one another adjacent the lowermost margin to close a lowermost end of the opening.

20. The portable container holder as claimed in claim 1, said base wall being attached to the back wall portion along both sides of the back wall portion.

21. The portable container holder as claimed in claim 20, said base wall extending from one of the sides of the back wall portion to the other side of the back wall portion.

* * * * *